United States Patent [19]

Elfving, deceased et al.

[11] 4,055,053

[45] Oct. 25, 1977

[54] THERMOELECTRIC WATER COOLER OR ICE FREEZER

[76] Inventors: Thore M. Elfving, deceased, late of San Mateo, Calif.; by Claes T. Eleving, executor, 10951 Santa Theresa Drive, Cupertino, Calif. 95014; Sven T. Elfving, 1560 Sandburg Terrace Apat.501, Chicago, Ill. 60610

[21] Appl. No.: 638,830

[22] Filed: Dec. 8, 1975

[51] Int. Cl.[2] ..... F25B 21/02; F25C 5/18

[52] U.S. Cl. ..... 62/3; 62/344

[58] Field of Search ..... 62/3, 394, 344, 379

[56] References Cited

U.S. PATENT DOCUMENTS

| | | | |
|---|---|---|---|
| 1,969,187 | 8/1934 | Schatt | 62/238 |
| 2,910,836 | 11/1959 | Karrer | 62/3 |
| 3,008,300 | 11/1961 | Ryan et al. | 62/394 |
| 3,049,892 | 8/1962 | Muffly | 62/344 |
| 3,088,289 | 5/1963 | Alex | 62/3 |
| 3,149,471 | 9/1964 | Boehmer et al. | 62/3 |
| 3,175,369 | 3/1965 | Murphy et al. | 62/3 |
| 3,192,726 | 7/1965 | Newton | 62/3 |
| 3,250,433 | 5/1966 | Christine et al. | 62/3 |
| 3,324,667 | 6/1967 | Muller | 62/3 |
| 3,412,566 | 11/1968 | Townsend et al. | 62/3 |
| 3,552,133 | 1/1971 | Lukomsky | 62/3 |

FOREIGN PATENT DOCUMENTS

| | | | |
|---|---|---|---|
| 1,351,990 | 3/1963 | France | 62/3 |

*Primary Examiner*—Lloyd L. King

[57] ABSTRACT

A thermoelectric water cooler or freezer including a thermoelectric assembly having P-type and N-type semiconductor material connected by junction bridges on their hot and cold junction sides. Heat exchange means are connected to the hot junctions and heat exchange means may be connected to the cold junction sides. The cold junction or the heat exchange means associated with the cold junctions, such as fins, extend upwardly and are adapted to be submerged in the water to be cooled or frozen. If an ice freezer is desired, the water is cooled until it freezes to a predetermined thickness on the fins, at which time the electrical current through the thermoelectric assembly is either interrupted or reversed for a short time allowing the fin temperature to rise and release the ice which then floats to the surface of the water where it is available for use.

16 Claims, 11 Drawing Figures

THERMOELECTRIC WATER COOLER OR ICE FREEZER

BACKGROUND OF THE INVENTION

The present invention relates generally to thermoelectric assemblies and more particularly to a water cooler or freezer incorporating a thermoelectric heat pump assembly.

There has been a need for a simple, inexpensive water cooler or ice freezer, particularly for use in the office or home. Presently, such water coolers and freezers employ compressor systems, are inefficient and expensive to operate. Of particular utility is a water cooler and freezer which can be used in connection with bottled water.

The present invention employs thermoelectric assemblies where the junction bridges are in the form of sheet metal strips disposed edgewise with respect to the surface of the hot and cold junctions of the semiconductor body. Such an assembly comprises junction bridges either in the form of a sheet metal strip placed edgewise and provided with a P-type body and one N-type body, or the junction bridges can be in the form of two sub-couples each provided with a junction bridge element in the form of a sheet metal strip placed edgewise and connected with only one semiconductor body. The two sub-couples are then connected to each other to form a junction bridge. A thermoelectric assembly, thermoelectric couples and thermoelectric subcouples of this type are described in our copending application Ser. No. 533,258, filed Dec. 16, 1974 and now U.S. Pat. No. 3,943,553.

OBJECTS AND SUMMARY OF INVENTION

It is a general object of the present invention to provide a thermoelectric assembly for water cooling or freezing having low thermal losses between the hot and cold sides of the assembly.

It is another object of the present invention to provide a thermoelectric assembly having maximum heat transfer between the cold junction bridges and the water for efficient water cooling and rapid freezing even at low temperature differences between the water and the cold junctions.

It is another object of the present invention to provide a water cooler or freezer assembly which has minimum losses to the surrounds.

It is a furthr object of the present invention to provide an ice freezer in which ice freezing takes place at high fin temperatures and the corresponding temperature of the cold side of the semiconductor bodies will remain only a few degrees Centigrade below freezing which means high efficiency and coefficient of performance with high freezing capacity in relation to input power.

It is still another object of the present invention to provide a thermoelectric ice cooler or freezer with automatic release of the ice from the surface on which it is frozen without the use of mechanical means.

It is still another object of the present invention to provide an ice freezer in which freezing of new ice pieces is automatically limited to the number of pieces that are able to be contained in the ice storage vessel and that when the vessel is full of ice pieces, these existing ice pieces will restrict releasing of new pieces.

The foregoing and other objects of the invention are achieved by a thermoelectric water cooler or freezer which includes a thermoelectric assembly having a plurality of thermocouples including bodies of P and N-type semiconductor material interconnected by flat hot and cold junction bridge elements disposed edgewise to the associated surfaces of the bodies. Heat exchange means connected to the cold junction side or the junction itself are directed upwardly to be submerged in the water which is to be cooled or frozen to conduct heat from the medium to the cold junctions and through the bodies to the hot junctions.

DESCRIPTION OF PREFERRED EMBODIMENTS

Figure 1:
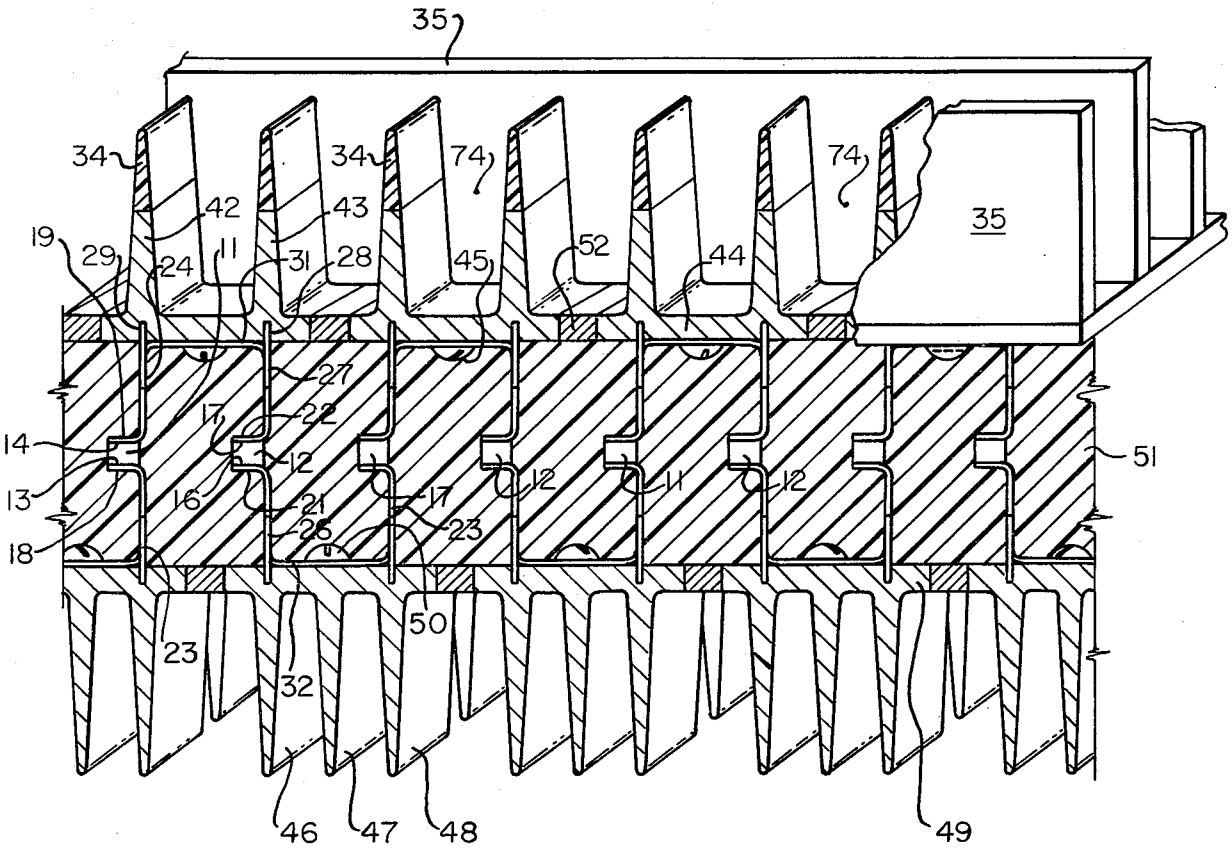
FIG. 1 is a partial view in perspective, partly in section, of a plurality of rows of thermoelectric sub-couples connected in series to form a thermoelectric assembly with the semiconductor bodies and other parts of the electric circuit embedded in an insulating structure.

FIG. 1 shows a plurality of semiconductor bodies 11 of one conductivity type and a plurality of semiconductor bodies 12 of opposite conductivity type. The bodies are of P-type and N-type thermoelectric semiconductor material and each body represents part of a thermoelectric sub-couple. Each body 11 and 12 has opposite faces 13 and 14, 16 and 17. The faces 13, 14 and 16, 17 are connected to junction bridge tabs or elements 18, 19 and 21, 22, respectively. The tab or element may be a portion of a junction bridge element which is made of sheet material and disposed at substantially right angles with respect to the face of the semiconductor body as shown at 23, 24 and 26, 27, respectively. The junction bridge elements are made of conductive sheet metal, preferably soft nickel-plated copper. Each junction bridge element is provided with the tab 18, 19 and 21, 22 which extends at right angles and is secured to the respective surfaces 13, 14 and 16, 17, respectively. The tab secured to the surface has substantially the same area as the surface of the semiconductor body whereby to minimize heat loss by heat interchange between tabs across the semiconductor body.

The semiconductor sub-couples, including the material 11 together with the connecting junction bridge elements, are joined on thier cold side to the semiconductor sub-couples, including the material 12, by a conductive strap 31 electrically connected between the two. The hot junction sides of the sub-couples 12 and 11 are interconnected by a conductive strip 32 whereby the sub-couples, including material 11, 12, are serially connected in a semiconductor thermoelectric assembly with the cold junction sides connected to the upwardly extending semiconductor bridge elements 24, 27 and the hot junction sides connected to the downwardly extending conductive bridge elements 23, 26. D.C. electric current is applied to the assembly by connecting to the element 24 or 23 of the first sub-couple and to the element 26 or 27, respectively, of the last sub-couple such as shown schematically in FIG. 6, whereby the d.c. current passes serially through the semiconductor material 11 and 12 of the assembly.

Figure 6:
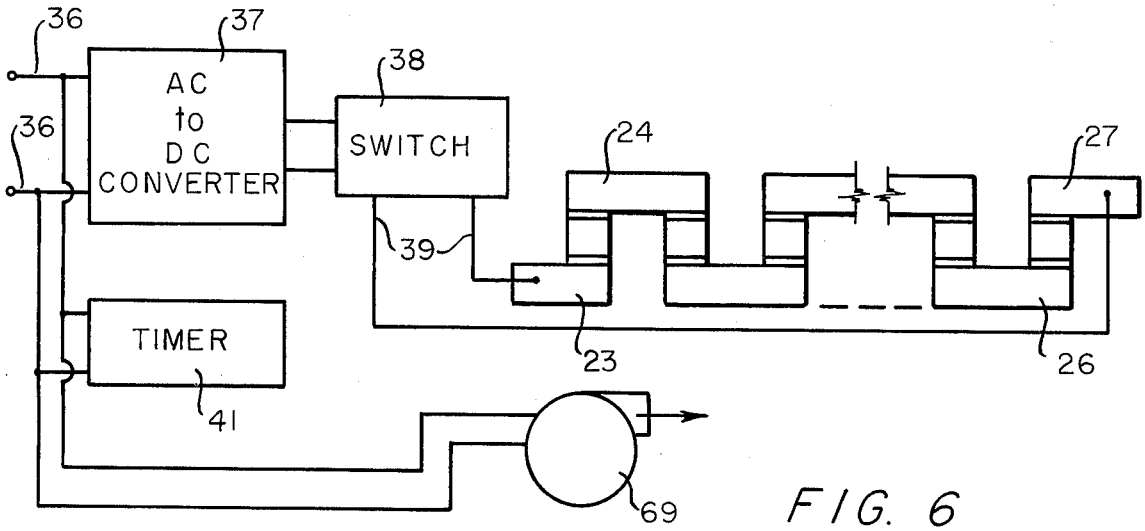
FIG. 6 shows a suitable electrical circuit for use with the thermoelectric assembly of the water cooler or freezer.

Referring particularly to FIG. 6, there is shown input terminals 36 which may be connected to an a.c. power source to apply the power to an a.c.-to-d.c. converter 37 which provides a d.c. currrent output to the switch 38. The switch 38 is adapted to connect the d.c. current to the serially connected semiconductor elements via leads 39. A timer 41 is associated with the input and serves to control the switch 38 as will be presently described. As is well known, rather than having an a.c.-to-d.c. converter, the power source may be d.c. directly either from batteries or from a d.c. power source.

The bridge elements 24, 27 on the cold junction side of the semiconductor assembly are each thermally connected to aluminum fins, such as fins 42 and 43, extending outwardly from a base 44 and thermally connected to the junction bridge elements 24 and 27 as by screw 45. The bridge elements 23, 26 on the hot junction side are likewise connected to a heat exchange fin assembly which in this instance includes fins 46, 47 and 48 extending outwardly from a base member 49 and adapted to be thermally connected to sub-couples 23, 26 by a screw 50.

The upwardly and downwardly extending fins serve to provide a means for heat exchange between the surrounds and the fins whereby heat is transferred from one set of fins to the other via the thermoelectric heat pump.

When used as a water cooler or freezer in accordance with the present invention, the upwardly extending fins 42, 43 are entirely submerged in the water to be cooled whereby to remove heat from the water and transfer it to the het dissipating fins 46, 47 and 48 via the action of the thermoelectric heat pump formed by the thermoelectric assembly. To prevent electrolytic processes, the aluminum fins are anodized or otherwise suitably treated before being connected to the sub-couples 24, 27.

The tips or upper portions of fins 42 and 43 are topped by a thermally non-conductive plastic material 34 which prevents water frozen in formed cups 74 from freezing together into a solid cake. The space between the rows of upard facing fins is separated by a similar non-conductive material 35. The space 74 formed between fins 42 and 43 and plastic separator 35 is, therefore, a contained space where an individual piece of ice will form. When the ice piece is released by the rise of temperature in fins 42 and 43, the ice floats upward and water immediately takes its place to be frozen as the temperature of fins 42 and 43 is again lowered.

The central part or core of the assembly shown in FIG. 1 containing the semiconductors and the junction bridge elements joined by the connectors represents the electric circuit and is embedded in a structure 51 of insulating material such as foam insulation, which material serves to support the assembly and form the top and bottom of the same. According to the invention, the exposed parts of the structure between the aluminum base plate 44 of the fins and the top and bottom of the assembly are covered or filled with a water-proof plastic compound such as epoxy 52 which prevents water from entering the inside of the assembly. This top portion of the assembly forms the corresponding bottom of the water container when the assembly is used as a water cooler or freezer.

Figure 2:
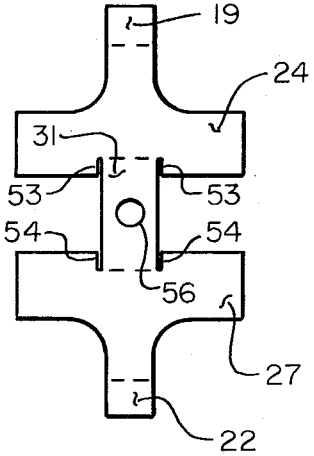
FIGS. 2 and 3 illustrate how two sub-couples in series are formed from a single sheet of metal by cutting and bending the metal so that a metal connector is formed between two sub-couples.
Figure 3:
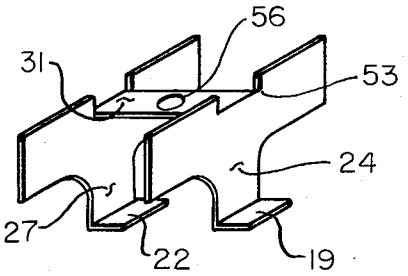

Referring particularly to FIGS. 2 and 3, there is shown an assembly which forms from a single piece of metal, the sub-couple junctions 24, 27 and the interconnecting member 31 or the sub-couples 23, 26 and their interconnecting member 32 from a single piece of sheet material. This member is formed from a single piece of material by cutting, stamping and bending. Referring to FIG. 2, the member is cut to the shape shown including, for example, a portion 24 and a portion 27 forming the junction bridge element, a portion 19 and a portion 22 defining the tabs and a portion 31 defining the interconnecting member. Slits 53 are formed in the junction element 24 while slits 54 are formed in the junction element 27. The cut-out sheet is then bent as shown in FIG. 3 to form the tabs 19, 22, the junction bridge elements 24, 27, the interconnecting element 31 with the upwardly extending portions of the elements for connection to the associated cooling fins. The depth of slits 53 and 54 enable junction bridge elements 27 and 24 to protrude up into grooves 28 and 29, respectively, in base plate 44, maximizing thermal connection. The screw 45 may be considered unnecessary if the fit of junction bridges 27 and 24 is snug enough to assure a tight fit. A hole 56 may be formed in the connector 31 to provide means for securing the fins to the assembly by means of a screw 45 such as shown in FIG. 1. It is apparent that the same structure can form tabs 18, 21, bridge elements 23, 26 and interconnecting element 32.

There has been provided a compact, easily constructed, well protected, strong and highly efficient thermoelectric heat pump assembly.

Figure 4:
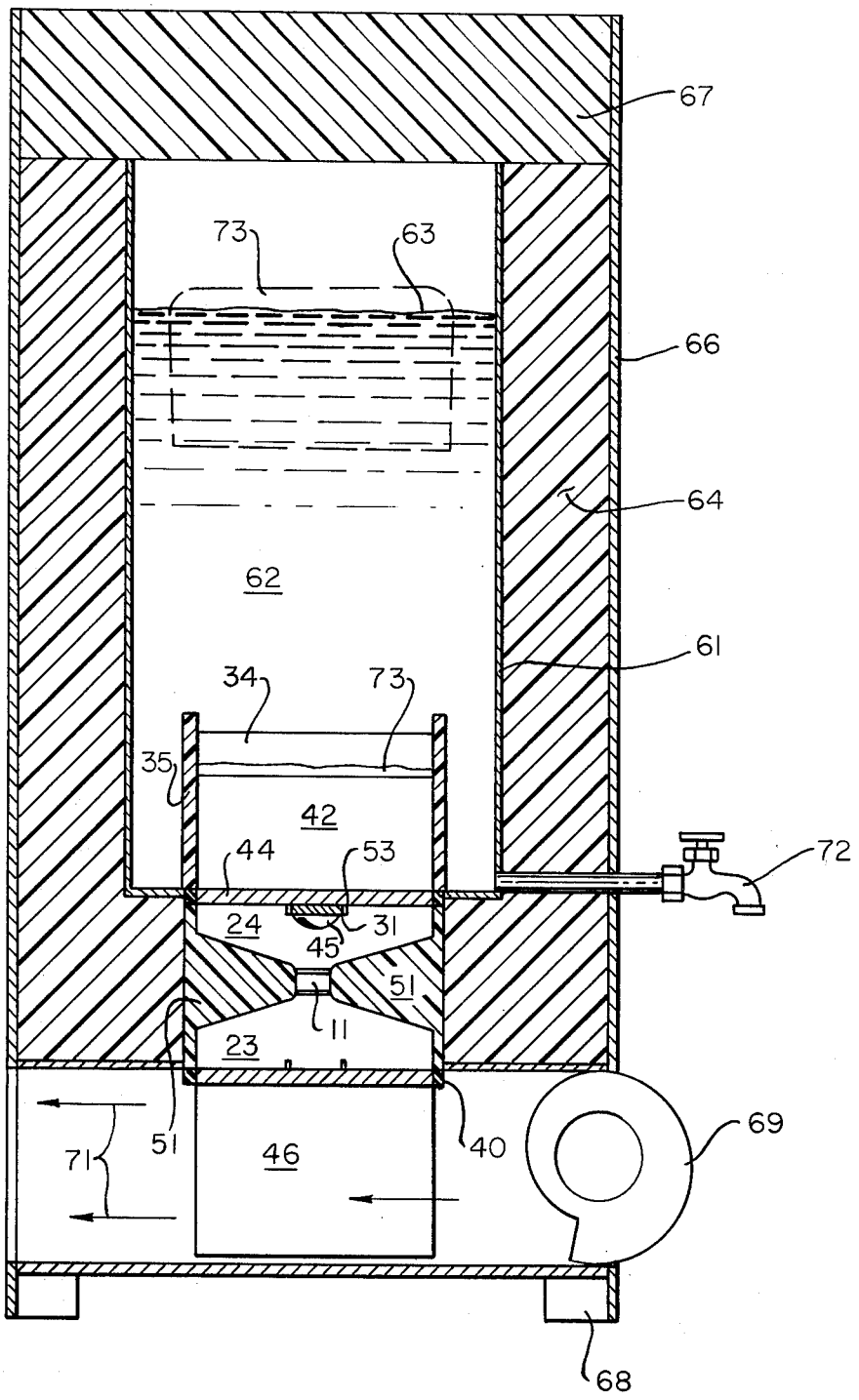
FIG. 4 is a sectional view of an ice freezer including a single module of the type shown in FIG. 1.

FIG. 4 illustrates how the assembly of FIG. 1 is used for a water cooler or freezer. The assembly is placed at the bottom of a water container 61 which is suitably secured and sealed to the edge and end portions of the assembly whereby it may be filled with the water 62 to a level such as shown at 63 and which completely submerges the upwardly extending heat exchange fins 42, 43. The container 61 may be a plastic or metal container which is suitably sealed to the thermoelectric assembly by means of epoxy or the like.

The container 61 is completely surrounded by insulating material 64 of suitable thickness which minimizes heat transfer from the water 62 to the surrounds. The outer surface of the insulating material 64 is protected by a housing 66. A top insulating cap 67 may fit within the housing 66 and rest on top of the insulating material 64 to completely enclose the water. The lower portion of the container 66 extends downwardly and is provided with supports 68. The lower portion of the housing serves to mount an air circulating means 69, such as a fan, which causes air to circulate past the heat dissipating fins 46, 47 and 48, as shown by the arrows 71. A faucet 72 may be provided to withdraw cold water from the cooler.

As previously described, the top surface of the thermoelectric assembly is suitably sealed by an epoxy or the like where the insulating material 51 is sealed. The housing, of course, will also serve to house the electrical system illustrated in FIG. 6 whereby to provide power for the thermoelectric assembly and also power to the fan 69 as shown in FIG. 6.

The water cooler or freezer shown in FIG. 4 operates in the following manner. When d.c. current is applied to the thermoelectric assembly and the container 61 is filled with water to a level above the fins, such as indicated by the level line 63, the thermoelectric assembly acts as a heat pump cooling the fins 42 below the freezing point. As the water temperature adjacent the fins is lowered, the surface of the fins is covered with a thin sheet of clear ice 73 which continues to grow as power is applied. The freezing absorbs heat from the water, which heat together with the heat generated by the electric current is dissipated by the fins 46, 47 and 48 to the surrounding air. After a predetermined time, a predetermined amount of ice 73 is formed on the fins. Current is then either interrupted with the result that the heat from the surrounding air is leaked through the assembly to bottom fins 42, 43 thereby melting the ice adjacent the fins and allowing the ice 73 to float upwardly to the surface. Preferably, a timer such as shown in FIG. 6 is included which serves to reverse the direction of current to more rapidly heat the fins and release the ice. When ice is required, the insulating top 67 is removed and the individual floating ice pieces can be obtained by use of spoon, fork or the like.

An important feature of the present invention is that the ice is automatically released from the fins by the interruption or reversal of current to the heat lamp pump assembly and no mechanical means are required for release of the ice. By the use of slightly inclined fin surfaces, the time required for release of ice is considerably shortened thereby conserving on energy.

Figure 5:
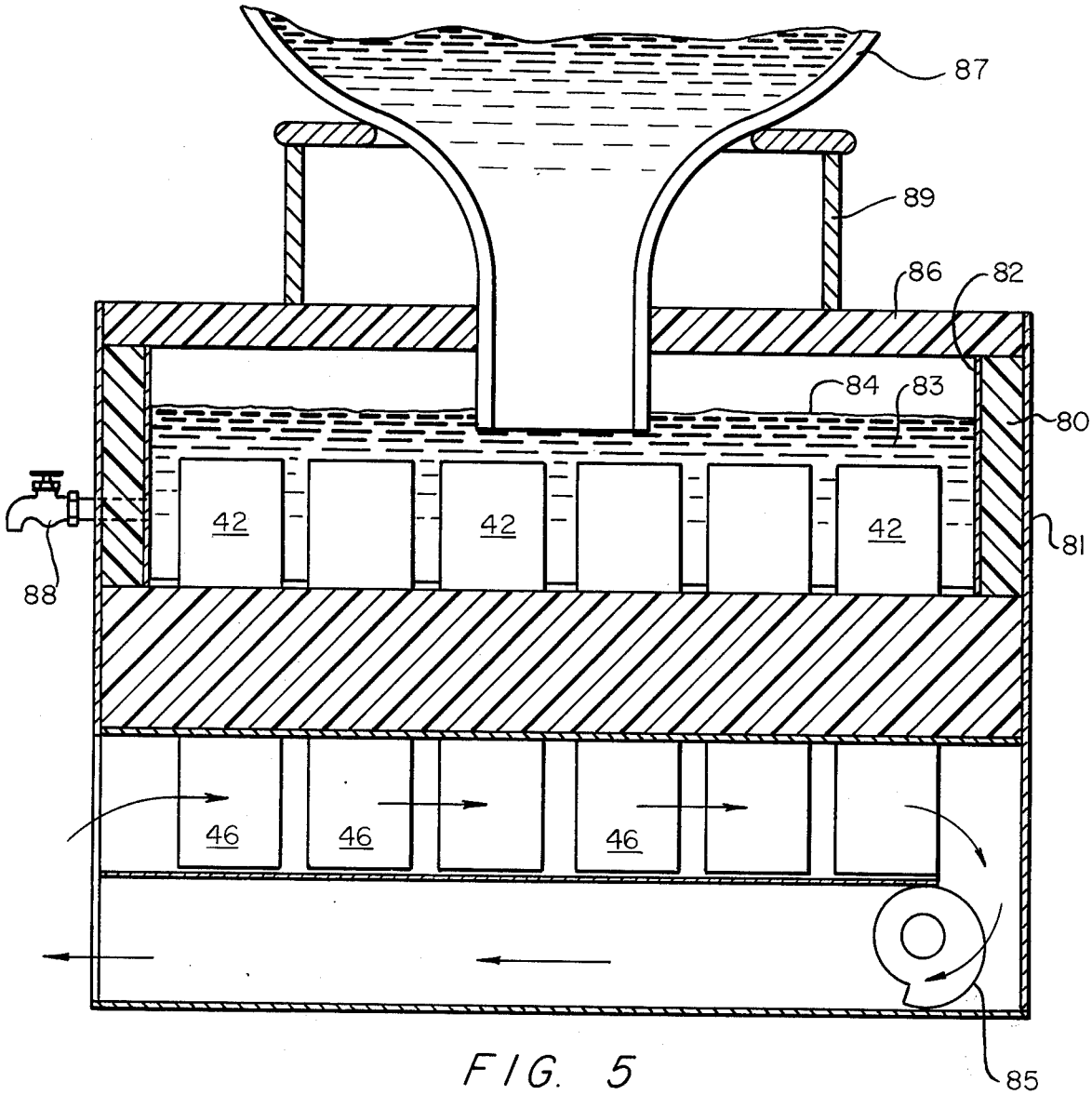
FIG. 5 is a sectional view of a water cooler comprising six rows of modules of the type shown in FIG. 1.

FIG. 5 shows a row of six of the thermoelectric heat pump assemblies just described. These are disposed in a housing 81. As before, there is provided a water container 82 which is suitably sealed to the assembly and is adapted to hold the water 83 to a level such as shown at 84. The water container 82 is surrounded by insulating material 80 disposed between the container and housing 81. As before, the housing serves to support the assembly and at the bottom of the housing a fan 85 is provided for circulating air past cooling fins 46, 47 and 48 to dissipate heat to the surrounds. A suitable insulated cap 86 is provided at the top. The housing also includes a support 89 adapted to receive a water bottle 87 which extends downwardly with its mouth at the water level 84. Cooled water can be removed from the container 82 by means of a suitable faucet 88 and as the water level 84 drops below the mouth of the bottle, additional water flows into the container thereby maintaining the level until the bottle is empty. The thermoelectric assemblies are suitably secured to one another and sealed whereby to provide the bottom for the water container 82. Again, a suitable power supply such as shown in FIG. 6 is associated with the water cooler. However, in this instance, the circuit may be simplified since a timer is not required for the release of ice. On the other hand, the container may be taller and the assembly may provide for both ice freezing and water cooling as desired.

Figure 7:
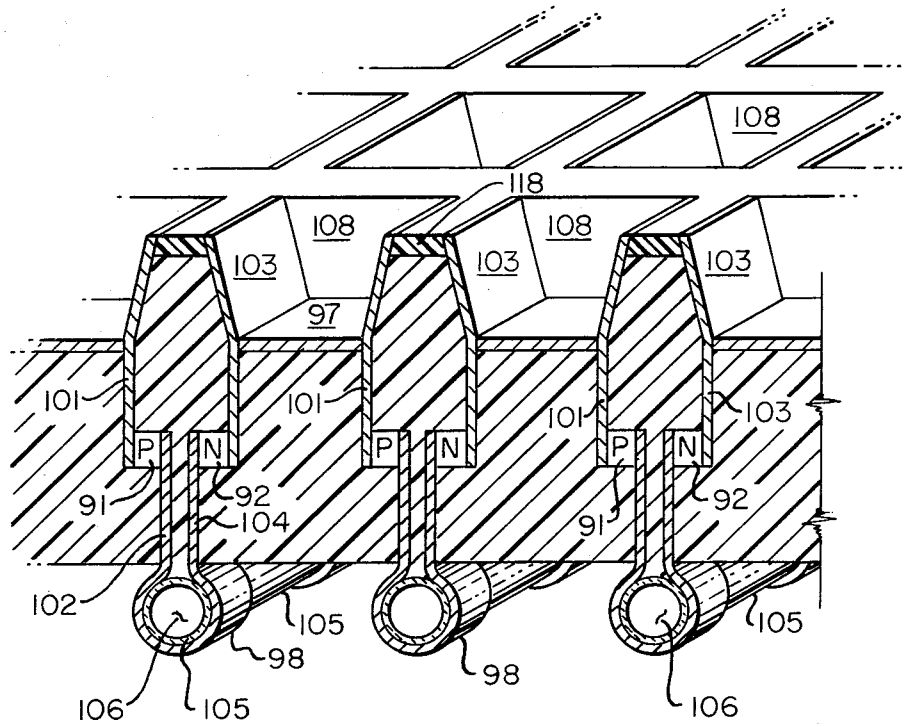
FIG. 7 shows a sectional view of a row of thermoelectric sub-couples connected in series to form a thermoelectric assembly with the semiconductor bodies and other parts of the electric circuit embedded in an insulating structure with the upper portion of the cold junction bridge elements and their electrical connector in the shape of a cup with tapered sides for ice freezing and where the connector between the hot side junction bridge elements is cooled by a heat dissipating liquid.

FIG. 7 shows a thermoelectric assembly having maximum heat transfer between the cold junction bridges and the water for maximum efficiency in water cooling and freezing. The water is in contact with the cold junction bridge and freezes within the confines of the bridge itself. The assembly consists of a plurality of semiconductor bodies 91 of one conductivity type and a plurality of semiconductor bodies 92 of opposite conductivity type. The bodies are of P-type and N-type thermoelectric semiconductor material and each body represents part of a thermoelectric sub-couple. Each body 91 and 92 is connected to the extremities of vertical elements 101, 102 and 103, 104, respectively. The elements are substantially parallel with respect to the face of the semiconductor bodies and have substantially the same width as the semiconductor bodies. The elements are arranged whereby they do not have any interfacing surfaces beyond the semiconductor bodies.

The semiconductor sub-couples, including the material 91 together with the connecting junction bridge elements 101 and 103, are joined on their cold side to the semiconductor sub-couples, including the material 92, by a conductive sheet metal piece 97 made from similar material as the vertical elements and electrically connected between the two elements 101 and 103 to form the junction bridge. The hot junction sides of the bodies 91 and 92 are connected with vertical elements 102, 104 and in electrical contact with each respectively. Thereby, the sub-couples including semiconductor bodies 91, 92 are serially connected in a semiconductor thermoelectric assembly with the cold junction sides connected to the upwardly extending conductive bridge elements 101, 103 and the hot junction sides connected to the downwardly extending conductive bridge elements 102, 104.

The upward facing vertical elements 101 and 103 are slanted to form inclined surfaces. The vertical elements 101 and 103 are joined together by a sheet metal piece 97 which forms the bottom of a cup. The enclosed portions of elements 101, 103 form the side walls of the cup respectively. The cup that is formed in this manner when closed at the front and back by a suitable plastic material 108 is capable of containing water for cooling or freezing. The elements 101 103 are bent inclined so that when the ice formed is released, it is easily released. The space between the inclined surfaces is provided with heat insulating walls 108 to define individual ice cups which will provide ice cubes.

Figure 8:
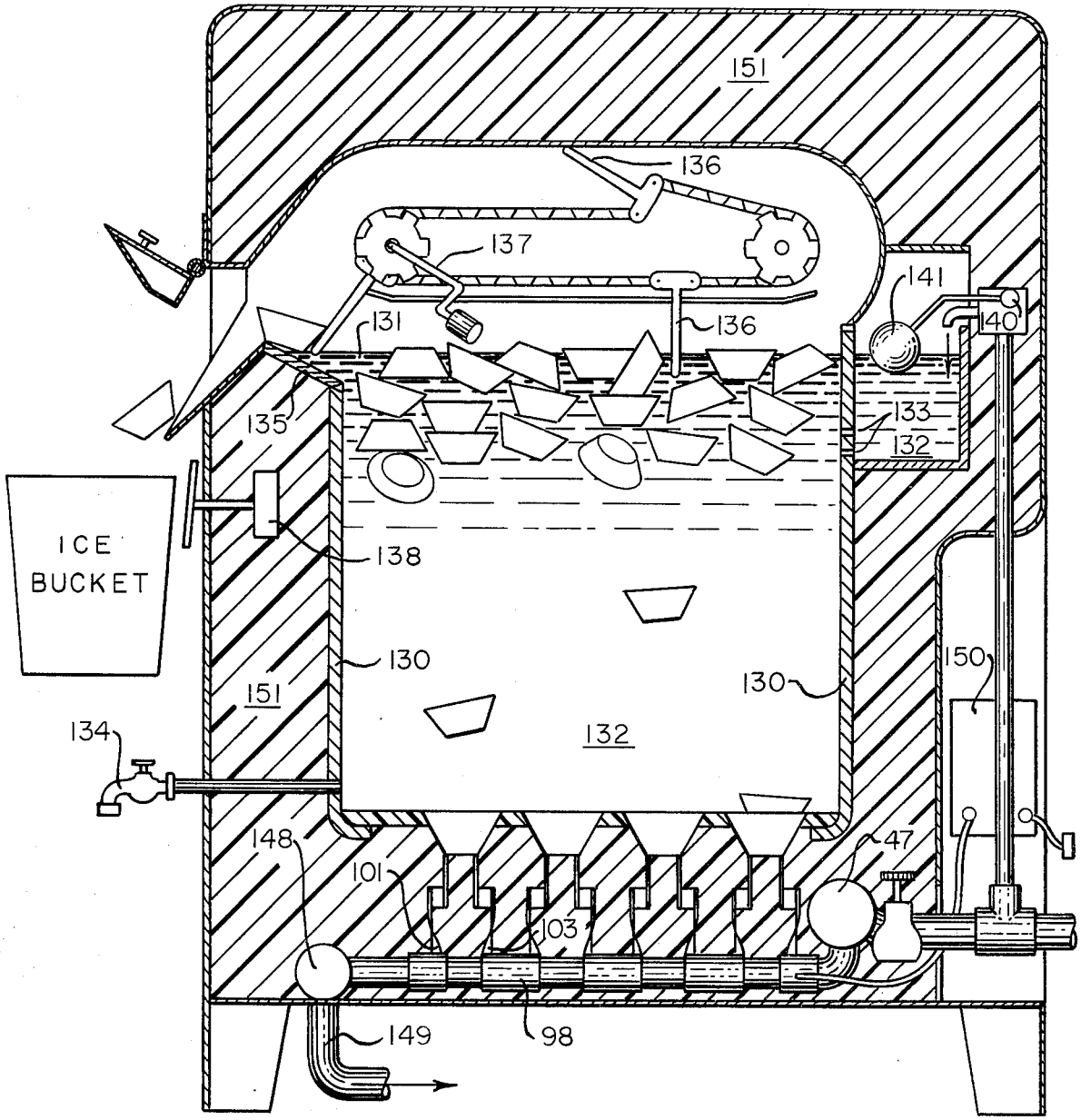
FIG. 8 is a sectional view of an ice freezer-water cooler including rows of modules of the type shown in FIG. 7.

The thermoelectric assembly is designed to be placed at the bottom of a vessel containing water such as is illustrated in FIG. 8. The upwardly facing cups are automatically filled by liquid in the vessel and cooling or freezing can take place. Heat is removed from the water contained in the junction bridge cup itself whereby to transfer it to the hot junction side of the thermoelectric assembly via the action of the thermoelectric heat pump formed by the thermoelectric assembly.

The hot junction side of the assembly is in the form of downward facing elements 102 and 104 and a connecting strap 98 which is wrapped substantially around a ceramic non-electrical but thermal conductive pipe 105 made from a material such as aluminum-oxide or beryllium-oxide. The elements 102 and 104 similar to elements 101 and 103 increase in width from their minimum width at the top where they contact the semiconductor bodies 91 and 92 gradually to their maximum width at the lower portion where they are connected by strap 98. The ceramic pipe 105 is in a known manner metallized on the outside in sections so that the connecting strap 98 is soldered on the inside to the outside of the ceramic pipe 105 thereby reducing to a minimum any thermal resistance. Cooling liquid 106 flows in the pipe 105 to absorb heat from the fluid being frozen together with the heat generated by the electric current in the thermoelectric heat pump. It may be advantageous from a manufacturing point of view to have the heat dissipating means run parallel to the direction of the row of cups or electrical circuits. FIG. 7 shows the heat dissipating ceramic pipe 105 with attached electrical connectors 98 assembled perpendicular to the direction of the row of cold junction cups. The hot junction bridge elements 102 and 104 can easily be reoriented to allow the heat dissipating means to lay in the same vertical plane and parallel to the electical circuit as is shown in FIG. 8. In the alternative, the pipe may run in the direction shown in FIG. 7.

Figure 9:
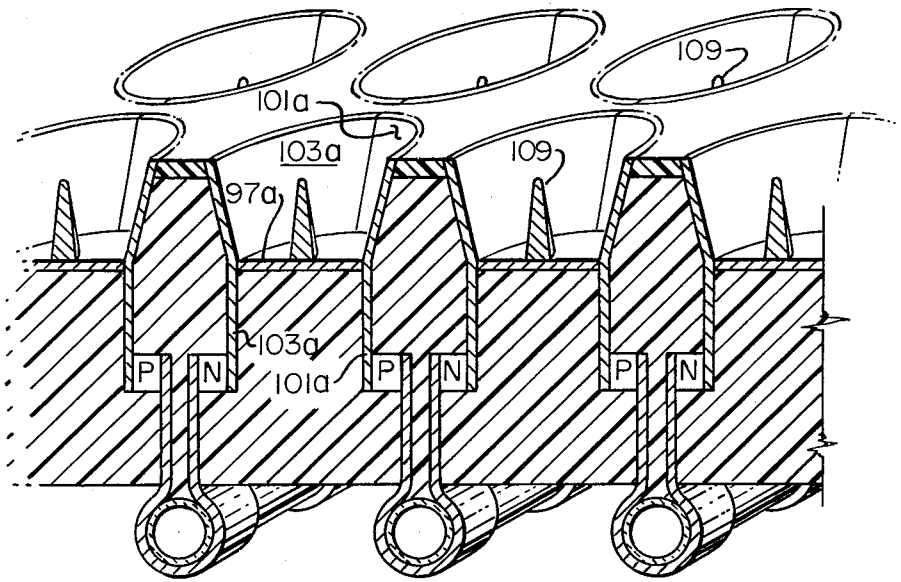
FIG. 9 shows a thermoelectric assembly as in FIG. 7 in which the cups are rounded.

The cold junction elements 101 and 103, where they form freezing surfaces for the water, do not necessarily have to be flat to form roughly rectangular ice cubes with slightly tapered sides, but they can also be rounded to completely surround the freezing area such as shown at 103*a* and 101*a,* FIG. 9, to form rounded ice cubes. In that case, the connecting piece 97a can be a round flat disc forming the bottom of the cup. The sides of the round cup are tapered outward to allow for easy release of the round ice cubes. In FIG. 9 rows of cold junction bridge cups are shown having a freezing post 109. The freezing post 109 is soldered or in other ways in maximum thermal contact with the connecting strip or disc 97*a.* The freezing post greatly reduces the freezing time required to form each ice cube. The post 109 should be tapered to allow for immediate release of the ice when the current is either interrupted or reversed. The cold junction cups with or without the freezing post are preferably chromed on the inside to avoid excessive oxidation.

Figure 10:
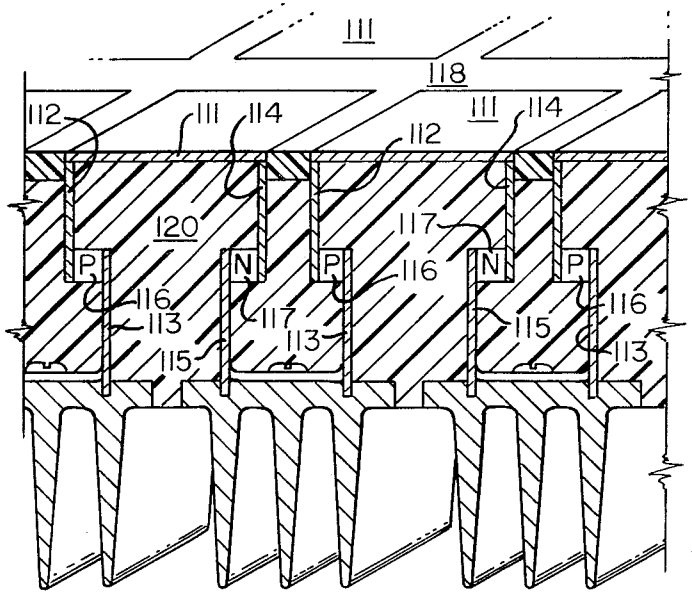
FIG. 10 is a sectional view of a row of thermoelectric sub-couples connected in a series to form a thermoelectric assembly where only the electrical connecting means between the edgewise disposed vertical cold junction bridge elements protrude from the sealed structural non-conductive insulation material.

FIG. 10 shows a thermoelectric assembly with a plurality of semiconductor bodies connected in series with vetical elements 112, 113, 114 and 115 positioned edgewise with respect to the face of the semiconductor bodies. The vertical elements 112 and 114 are joined electrically on the cold side by a metal conductor 111, which metal conductor 111 protrudes out of the sealed structural insulation material 118 and 120. The conductor may be a flat metal piece 111, FIG. 10, or may be a solid post 110, FIG. 11, made from a like material as elements 112 and 114. The lower portions of elements 112 and 114 are no wider than the semiconductor bodies 116 and 117 but increase in width towards the top to allow a better thermal contact with conductor 111 or 110, but it is most important that the least amount of area be exposed to the hot junction elements 113 and 115 even though insulation material 120 surrounds the elements.

The hot side or junction and heat dissipating means are identical to those described in FIG. 1 with the junction bridge cut out of one piece of sheet metal as described in FIG. 2 and bent as described in FIG. 3 and attached to heat dissipating aluminum fins as described in FIG. 1. The electrical hook-up is identical to that of FIG. 6.

Figure 11:
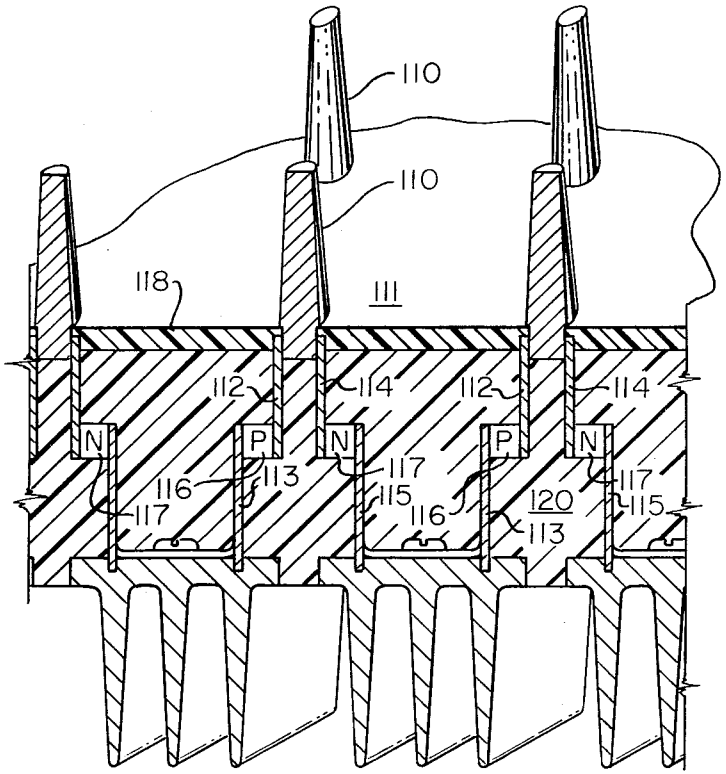
FIG. 11 is a thermoelectric assembly as in FIG. 10 in which the bridge elements are freezing posts.

In FIGS. 10 and 11 the freezing surface or cooling surface is the connecting piece of the junction bridge itself. The spaces between the cold junction bridges are filled with an electrically and thermally non-conductive material 118. The non-conductive material 118 prevents the individual pieces from freezing together into one solid flat cake of ice. The ice or cooling of water takes place on the junction bridge itself and has maximum heat transfer between the cold junction bridge and the water.

When an assembly uses only flat connectors 111, then the thermoelectric assembly described in FIG. 10 may be placed either flat or at any angle in contact with a liquid. When the assembly is submerged, ice floats to the top, regardless of angle.

A freezing post such as in FIG. 11 is preferably used when the assembly is intended to be submerged in a horizontal position. The tapered post 110 can be attached to the middle of a flat conductor 111 and then ice is frozen on top of plate 111 and around post 110. This provides more rapid freezing.

As previously described, FIG. 8 shows how the assembly of FIG. 7 is used for a water cooler of an ice maker. Only one row is shown out of several parallel similar rows in the thermoelectric assembly. The assembly is placed at the bottom of a water container which is suitably secured and sealed to the edge and end portions of the assembly whereby it may be filled with the water 132 to a level as shown at 131 and which completely submerges the upwardly facing junction bridge cups and also submerges the lower edge of an inclined plane 135 which is placed in such a position as to permit the skimming of the individual ice pieces along the surface and gently push them up out of the water. A means is shown whereby blades 136 used for skimming the cubes are mechanically arranged so that the blades skim across the surface of the floating ice water mixture in one direction and dips down deep enough to engage at least one layer of ice cubes. The skimmer may be activated by a hand crank 137 and turned only as long as to attain the desired quantity of ice cubes, or known means may be arranged whereby an electrical motor will activate the skimmer when electrical switch 138 is activated. The depth of the water vessel allows for a large amount of stored ice pieces. By storing the ice floating in water in the vessel and only removing the pieces as required, the water temperature remains very close to the freezing point. As a result, once the ice maker has cooled down the initial supply of water and produced three or four sets of ice, the ice maker can be said to have reached its state of equilibrium and from that point on ice freezing is very rapid. When a quantity of ice is removed, the water level drops and as a result fresh water is introduced into the tank through valve 140 which is actuated by a float 141. This float mechanism and water inlet is separated from the main water and ice storage vessel by the vessel wall; however, several small holes 133 allow free passage of water between the two chambers. The reason for keeping the float mechanism separated from the main tank is that ice pieces cannot contact the float mechanism. The fresh water that is introduced through the small holes 133 does not raise the temperature of the water unless almost all of the ice has been removed. The result is that the thermoelectric heat pump assembly works with very small temperature differences which is ideal from a theoretical thermoelectric point of view and the coefficient of performance far exceeds those of compressor or absorption refrigeration means.

The water vessel or reservoir 130 is provided with a faucet 134 for draining. Filling takes place as described via valve 140 controlled by float body 141. It is necessary to maintain the salt and mineral content of the water within tolerable limits. As freezing takes place, salt and other minerals are rejected by the freezing water, and the concentration of salt and minerals in the water increases. If the water is used as a source for a drinking fountain and water is regularly used, then the problem of salt and mineral concentration is of negligible concern. Otherwise, the freezer must be drained when the concentration increases.

FIG. 8 shows arrangement of the heat dissipating ceramic pipe attached to an inlet header 147 and outlet header 148 connected to a drain via pipe 149. The headers 147 and 148 need not be ceramic. Header 147 is attached to main cold water supply.

Thus, there has been provided a thermoelectric water cooler and/or ice freezer with storage means and whereby individual ice pieces automatically float up and away from their freezing location. Means are provided for removing the ice from its storage vessel when desired. Means are provided for automatically filling when the level of the water drops. The water cooler and ice freezer works at a higher coefficient of performance than conventional freezing or cooling means. It is simple in design and economical in construction.

What is claimed is:

1. A thermoelectric water cooling or freezing assembly comprising semiconductor bodies of P-type and N-type semiconductor material each having hot and cold sides of predetermined area with similar sides adapted to be connected in series by junction bridges to form thermocouples, said junction bridges including thin sheet metal portions disposed edgewise with respect to the associated semiconductor body with one edge in conductive contact with the associated side of the semiconductor body and with the other edge adapted to be associated with heat exchange means to the surrounding media, characterized in that an individual heat exchange means is associated with each cold junction bridge, said heat exchange means facing upwardly and adapted to freeze at least one ice cube and container means are provided to hold water in heat exchange with each of said heat exchange means.

2. A thermoelectric assembly as in claim 1 wherein said junction bridges comprise a pair of said thin sheet metal portions, one connected to a P-type semiconductor body and the other to an N-type semiconductor body and connecting means for interconnecting the thin sheet metal portions to form junction bridges and connect the semiconductor bodies in series.

3. A thermoelectric assembly as in claim 1 wherein the individual cold junction heat exchange means comprise aluminum with fins and wherein the aluminum on at least the cold junction side is treated to prevent electrolytic action.

4. A thermoelectric assembly as in claim 3 wherein the aluminum fins on the cold side face upwards and are tapered for quick release of ice frozen on the same after the current to the thermoelectric assembly is reversed or interrupted.

5. A thermoelectric assembly as in claim 2 wherein the connecting means for interconnecting the sheet metal elements are formed from the same sheet metal from which the sheet metal elements are formed.

6. A thermoelectric assembly as in claim 1 wherein the thin sheet metal portions disposed edgewise to the surface of the semiconductor bodies are supported by a non-conductive structure in the form of insulation directly engaging both sides of said thin metal portions.

7. A thermoelectric assembly as in claim 6 wherein said non-conductive structure is sealed and forms the bottom of said water holding means.

8. A thermoelectric assembly as in claim 7 wherein the thin sheet metal portions protrude out of the sealed non-conductive insulation structure for direct contact with water.

9. A thermoelectric assembly as in claim 2 wherein the thin sheet metal portions disposed edgewise to the surface of the semiconductor bodies are supported by a non-conductive structure with the other edge and the connecting means protruding out of the non-conductive structure for direct contact with the water for cooling or ice freezing.

10. A thermoelectric assembly as in claim 9 wherein said thin sheet metal portions and connecting means form a cup or container volume for cooling or freezing of water.

11. A thermoelectric assembly as in claim 2 wherein the thin metal portion disposed edgewise to the surface of the semiconductor bodies are supported by a non-conductive structure with said connecting means extending past the non-conductive structure for direct contact with the water.

12. A thermoelectric assembly as in claim 11 wherein said connecting means is a flat metal plate.

13. A thermoelectric assembly as in claim 11 wherein the connecting means is a single tapered post or fin.

14. A thermoelectric assembly as in claim 9 wherein said cold junction bridge elements and connecting means are treated to prevent electrolytic action.

15. A thermoelectric assembly as in claim 2 wherein the hot junction bridge elements connecting means is substantially wrapped around heat exchange means.

16. A thermoelectric assembly as in claim 15 wherein said heat exchange means is a continuous ceramic heat conductive pipe treated in sections to allow connecting means to be thermally affixed thereto.

* * * * *